United States Patent [19]

Kajinaga et al.

[11] 4,234,168

[45] Nov. 18, 1980

[54] APPARATUS FOR PRODUCING LOW-OXYGEN IRON-BASE METALLIC POWDER

[75] Inventors: Yoshihiro Kajinaga; Minoru Nitta, both of Chiba; Ichio Sakurada, Ichihara; Shunji Ito, Chiba, all of Japan

[73] Assignee: Kawasaki Steel Corporation, Kobe, Japan

[21] Appl. No.: 942,374

[22] Filed: Sep. 14, 1978

Related U.S. Application Data

[62] Division of Ser. No. 775,924, Mar. 9, 1977, abandoned.

[30] Foreign Application Priority Data

Mar. 12, 1976 [JP] Japan ..... 51-26708

[51] Int. Cl.[3] ..... C21D 1/40; C21D 1/42

[52] U.S. Cl. ..... 266/128; 266/129; 266/137; 266/259

[58] Field of Search ..... 266/137, 128, 129, 259, 266/260, 208, 174; 219/7.5, 10.47, 10.49 R, 10.51; 75/0.5 BA

[56] References Cited

U.S. PATENT DOCUMENTS

| | | | |
|---|---|---|---|
| 1,691,349 | 11/1928 | Harrington et al. | 266/129 |
| 2,980,527 | 4/1961 | Strang | 266/137 |
| 3,429,563 | 2/1969 | Anderson et al. | 266/128 |
| 3,441,452 | 4/1969 | Westeren | 266/128 |
| 3,441,452 | 4/1969 | Westeren | 266/259 |
| 3,589,696 | 6/1971 | Westeren et al. | 266/128 |
| 3,966,454 | 6/1976 | Ito et al. | 75/0.5 BA |

FOREIGN PATENT DOCUMENTS 50-14594 3/1975 Japan .

*Primary Examiner*—L. Dewayne Rutledge
*Assistant Examiner*—Michael L. Lewis
*Attorney, Agent, or Firm*—Balogh, Osann, Kramer, Dvorak, Genova & Traub

[57] ABSTRACT

A process and an apparatus for producing low-oxygen iron-base metallic powder are disclosed. The low-oxygen iron-base metallic powder is produced by alloying and/or admixing iron-base metallic raw powder to be subjected to a final reduction, which has an apparent density in filled state corresponding to 16–57% of theoretical true density, an oxygen content of not more than 6% by weight and a particle size of not more than 1 mm, with carbon or carbonaceous granule in an amount corresponding to not more than an target alloying carbon content of a final product (% by weight) + an oxygen content of the powder just before the final reduction (% by weight) × 1.35 to form a starting powder, preheating the starting powder at a temperature of 780°–1,130° C. in a non-oxidizing atmosphere having a theoretical oxygen partial pressure of not more than $2.1\times10^{-1}$ mmHg and a dew point of not more than +5° C. to form a preheated and sintered cake (P-cake), induction heating the P-cake at a temperature of 850°–1,400° C. in the same atmosphere by applying an alternating power of 50 Hz to 500 kHz from power supply to effect deoxidation and decarburization to form an induction heated cake (I-cake), and then cooling and pulverizing the I-cake.

4 Claims, 3 Drawing Figures

APPARATUS FOR PRODUCING LOW-OXYGEN IRON-BASE METALLIC POWDER

Figure 1:
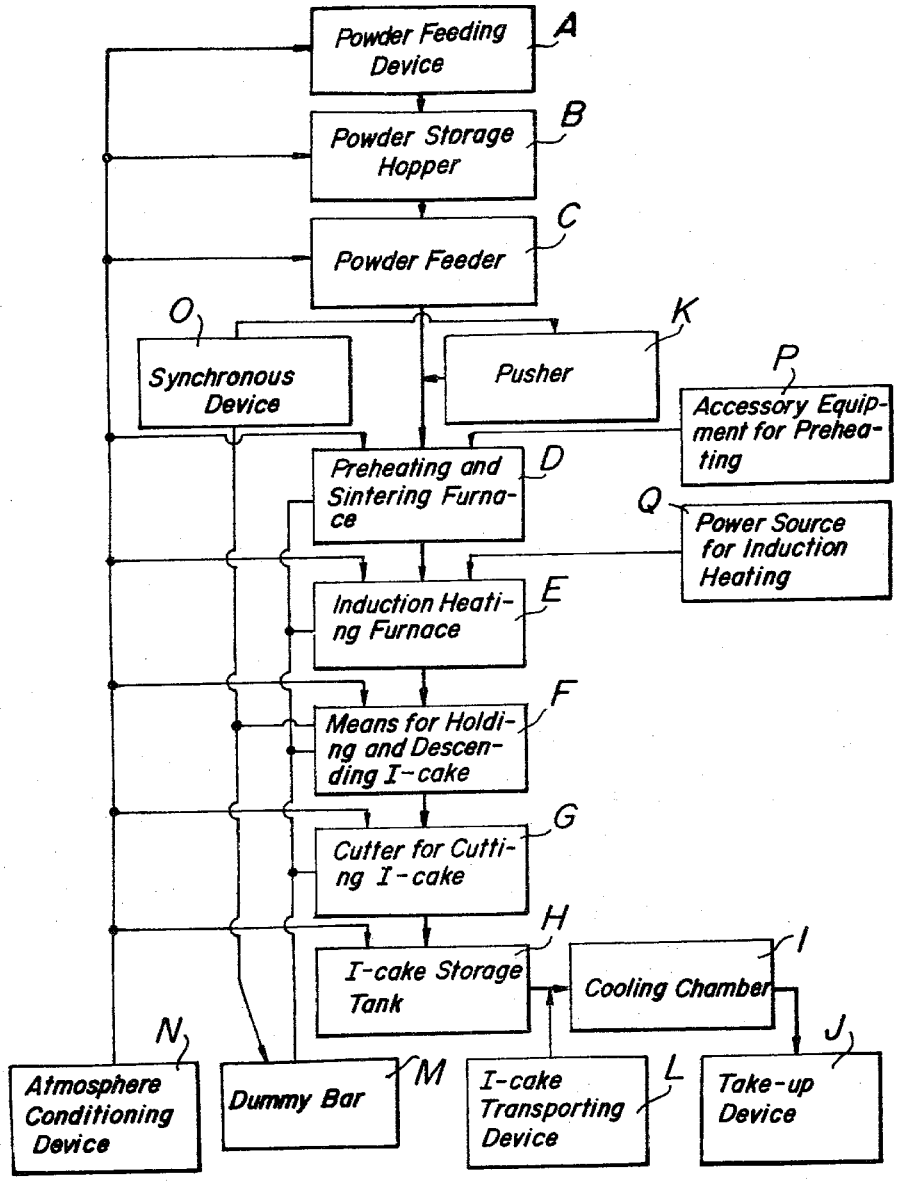

This is a Divisional of application Ser. No. 775,924 filed Mar. 9, 1977, now abandoned.

This invention relates to a proces and an apparatus for producing low-oxygen iron-base metallic powder for powder metallurgy inclusive of sintering and forging from iron-base metallic raw powders including pure iron powder, alloy steel powder and a mixture thereof.

The term "iron-base metallic raw powder" used herein means powders wherein metallic iron holds the first place on a basis of weight percentage and includes pure iron powder, alloy steel powedr or iron alloy powder containing an alloying element and the like.

In the latest powder metallurgy, there is a tendency to gradually spread applications from the manufacture of small-sized machine parts to the manufacture of high toughness machine parts, tools, large-size machine parts and material products (for example, plate materials and the like by powder rolling) in advance with high densification and high strengthening. In order to obtain these high strength products, there have been made various studies.

In this case, a most important factor is an oxygen content of the powder.

For instance, the iron-base metallic powder usually contains oxygen of 1,000–5,000 ppm even in the case of pure iron powder. If such powder is used as a starting material to manufacture a high density machine part, the fatigue strength and toughness are deteriorated. This fact is reported in almost every literatures and reports. Furthermore, the oxygen content is generally liable to increase in the case of low-alloy steel powder and high-alloy steel powder. Therefore, the art of producing the iron-base metallic powder has made much effort how to reduce the oxygen content.

In order to obtain low-oxygen powder by deoxidation of the iron-base metallic raw powder, there has hitherto been widely adopted a process comprising the steps of (i) using a reducing gas such as hydrogen and the like as a reducing agent, (ii) indirectly heating the reducing gas and powder to be reduced to effect deoxidation (during which, the powder is sintered into a cake), and (iii) pulverizing the resulting sintered cake. And also, there has been proposed a process wherein a mixture of the powder to be reduced and graphite granules as a reducing agent is indirectly heated by radiant heat to effect the deoxidation. In any case, these prior arts are to indirectly heat the powder by an external heating system, so that there are various restriction in the apparatus such as heat resistance of materials constituting a reaction chamber of the furnace and the like and the heating temperature cannot be raised highly. Consequently, the effective deoxidation cannot be yet expected.

Furthermore, the individual particle of the powder is externally heated by radiant heat, heat exchange with a reducing gas (i.e. convection), thermal conductance and the like, so that a long reduction time is required, during which the sintering between the particles proceeds inevitably, and as a result a problem of deteriorating the pulverizability of the cake after final reduction is caused. Under such circumstances, it is very difficult to cheaply produce low-oxygen iron-base metallic powder in large quantities.

Accordingly, in order to facilitate the deoxidation, there is made an attempt to add an alloying element such as nickel, molybdenum and the like to the iron-base metallic powder. However, if inexpensive manganese, chromium and the like, which are usually used in ingot steel materials, are previously alloyed in the powder obtained by an industrially low-cost method, e.g. by a water atomizing method, these elements are easily oxidized. However, there has not yet been developed an effective deoxidation method. If it is intended to subject the resulting powder to final reduction by a usual manner, the conditions of temperature and atmosphere becomes more severe and the operation is largely accompanied with difficulty and necessarily brings upon the increase of cost.

Moreover, the pulverizing of the cake following to the final reduction is extremely poor because the reduction step takes a long time and the sintering between the particles of the powder proceeds undesirably and also the cake becomes considerably hard. After the pulverizing the work strain remains in the powder particles and hence the particles themselves are hardened, so that the formability of the resulting powder is deteriorated.

It is, therefore, an object of the invention to solve the above mentioned drawbacks by a simple process and to easily produce low-oxygen iron-base metallic powder having an improved formability in a vertical type apparatus wherein iron-base metallic raw powder obtained by various conventional methods is preheated in a non-oxidizing atmosphere to reduce a part of oxygen in the particles of the powder prior to the final reduction and also to decrease a total amount of carbon including alloyed carbon to thereby adjust the reduction condition and then heated by an internal heat built-up (i.e. induction heating) in the same atmosphere, whereby the heating time is considerably shortened and as a result the pulverizing of the cake after the final reduction is facilitated.

That is, there is provided a process for producing low-oxygen iron-base metallic powder, characterized by alloying and/or admixing iron-base metallic powder to be subjected to a final reduction, which has an apparent density corresponding to 16–57% of theoretical true density in filled state, an oxygen content of not more than 6% by weight and a particle size of not more than 1 mm, with carbon or carbonaceous granule in an amount corresponding to not more than an objective alloying carbon content of a final produce (% by weight) + an oxygen content of the powder just before the final reduction (% by weight)$\times$1.35 to form a starting powder, preheating the starting powder at a temperature of 780°–1,130° C. in a non-oxidizing atmosphere having a theoretical oxygen partial pressure of not more than $2.1\times10^{-1}$ mmHg and a dew point of not more than +5° C. to form a preheated and sintered cake (hereinafter abbreviated as P-cake), induction heating the P-cake at a temperature of 850°–1,400° C. in the same atmosphere by applying an alternating power of 50 Hz to 500 kHz from power supply to effect deoxidation and decarburization to form an induction heated cake (hereinafter abbreviated as I-cake), and then cooling and pulverizing the I-cake.

According to the invention, the followings are essential features:

(1) Carbon is contained as a reducing agent in the starting powder.

(2) The real and effective deoxidation is carried out by induction heating.

(3) The starting powder is sintered by preheating in order to conduct the subsequent induction heating effectively.

(4) The non-oxidizing atmosphere is held in order to conduct the deoxidation effectively and to prevent reoxidations of P-cake and I-cake.

Thus, the process of the invention is a reducing agent-involving system wherein the effective and efficient deoxidation of the iron-base metallic raw powder is promoted by a direct reaction of alloyed carbon in the starting powder with oxygen contained in the starting powder (usually oxides) during the direct induction heating of the starting powder and is entirely different from the conventional reduction system such as gas-solid reaction wherein the powder does not involve the reducing agent and is deoxidized by an external reducing gas. Namely, according to the invention, the induction heating system wherein a heat is generated in the starting powder itself is adopted, so that there is substantially no restriction to the heat resistance, oxidation resistance and the like in the reaction part of the apparatus and the heating temperature can be elevated higher as far as possible, whereby the more effective deoxidation can be accomplished. Furthermore, the temperature rise of the whole P-cake is attained in a very short time. And also, in the induction heating, an induction eddy current is induced in the particles of the powder to generate the heat in the interior of the particle and as a result, the diffusion of alloyed carbon in the powder is promoted, whereby the deoxidation reaction proceeds and finishes in a short time. These short times for the temperature rise and for the deoxidation are very important factors in the final reduction, whereby the excessive sintering of I-cake is prevented though the heating is effected at an elevated temperature, and the pulverizability of I-cake after cooled is satisfactorily retained as a result of rapid gas generation.

The invention is applicable to all sorts of the starting powders for the final reduction corresponding to a final reduction of iron-base metallic raw powder, for example, reduced iron powder, atomized iron powder, mechanically pulverized iron powder, electrolytic iron powder and the like independently of the methods of producing these powders or the alloy composition or the presence of oxides.

The invention will be described with respect to the case of using the reduced iron powder and atomized iron powder as the iron-base metallic raw powder.

The reduced iron powder is usually produced through a primary rough reduction step and a secondary reduction step. The rough reduced iron powder, which is obtained by pulverizing sponge iron produced through the primary rough reduction step, contains an oxygen of about 0.7% to 2%. This oxygen is partly included as iron oxide in the particles of the powder or may be existent as independent iron oxide particles. The sponge iron contains some amount of carbon due to carburizing phenomenon at the rough reduction step. The carbon content can be increased or decreased optionally. In the common sponge iron, however, the carbon content is less than the oxygen content, so that according to the invention it is necessary to alloy a given amount of carbon in the rough reduced iron powder, for example, by subjecting to a preliminary treatment such as gas carburizing or to admix the rough reduced iron powder with carbonaceous granules such as graphite granule and the like. Of course, the carbon content may be increased by carburizing the sponge iron at the rough reduction step or a post treatment step prior to the pulverization.

When the process of the invention is applied as the final reduction following to the above mentioned procedure, the effective deoxidation can be achieved. If it is intended to make up for a deficiency of the carbon content by admixing with graphite granule, it is necessary to satisfactorily alloy the carbon in the powder at the preheating step according to the invention.

In case of using the atomized iron powder (inclusive of alloy steel powder), it is possible to effect the pulverization by atomization after carbon is alloyed in the molten steel, so that the process of the invention can be more effectively applied to the final reduction of the powder. In the powder just after atomized, a so-called non-metallic film of oxide and/or hydroxide is formed on the surface of the particles of the powder. For this reason, the process of the invention is entirely different in the reduction mechanism from the conventional gas reduction system.

In the gas reduction system, the particles of the atomized iron powder are reduced from the surface thereof by an external heating, whereby the metal portion as a reduction product is formed on the surface of the particles. As a result, unreduced portions are sandwiched between the metal portions in the center and surface of the particle during the course of the reduction. Therefore, the reduction proceeds, for example, through a series of the following complicated processes:

(i) a mutual diffusion of a reducing gas and a waste gas (after the reduction) in gas boundary layer near the surface of the particle, (ii) a heat exchange of a reducing gas with the particles of the powder (inclusive of radiant heat and heating by heat conductances in the particles and between the particles), (iii) a solutionization of carbon or hydrogen from a reducing gas into the metal layer on the surface of the particle, (iv) a diffusion of solutionized carbon or hydrogen into an interface between the reduced and unreduced portions, (v) a reduction reaction at the interface between the reduced and unreduced portions, and (vi) a discharge of the waste gas from the particle.

Moreover, one of the above mentioned processes is a rate determining step and the progress of that step becomes slow, so that the deoxidation rate also becomes slow.

According to the invention, the final reduction of the iron-base metallic raw powder is carried out in various non-oxidizing atmospheres of reducing gas, neutral gas, inert gas and the like or in vacuum. Now, the reduction mechanism of the atomized iron powder according to the invention will be described, for example, in a non-oxidizing atmosphere having a thermodynamically calculated oxygen partial pressure of not more than $2.1\times10^{-1}$ mmHg, i.e. under higher vacuum having a vacuum degree of not more than 1 mmHg (in this case, the dew point of the atmosphere inevitably becomes not more than +5° C.).

Different from the conventional gas reduction system, the invention is to heat the powder with Joule's heat generated by utilizing induction eddy current induced at a metal portion in the interior of the particles as mentioned above. Since the heat is generated in the particles themselves, the diffusion of alloyed carbon in the interior of the particle is promoted and also the reduction reaction at the interface with the non-metallic film rapidly proceeds. That is, the reduction proceeds from the interior of the particle. Furthermore, the gas formation at the interfce is fast, so that the pressure of the formed gas rapidly rises. This pressure rise serves together with the vacuum outside the particles to easily break the non-metallic film on the surface of the particle. As a result, the reduced gas is discharged out of the particles and also the reaction at the interface is retained in a faster state. Thus, in the process of the invention in which the particles of the powder, each containing carbon as the reducing agent, are rapidly and forcedly heated by the induction heating, there is not observed the phenomenon that the reduction rate considerably lowers in the course of the reduction as in the conventional gas reduction system. Moreover, the waste gas rapidly runs away from the surface of the particles due to the vacuum, so that the gas boundary layer is not formed near the surface of the particles. Although it is considered that the gas boundary layer is somewhat formed near the surface of the particles in the interior of the charged powder, a part of the layer may be further reduced by CO gas generated at higher temperature.

As mentioned above, the feature that the reduction is caused from the interior of the particle is considerably convenient. Firstly, the reduction process is simplified and the reduction rate is maintained in a faster state because the unreduced portion is not sandwiched between the metal portions of the particle different from the conventional gas reduction system. Secondly, the metal portion produced from the interior of the particle toward the surface thereof has always a low carbon concentration and hence the gradient of carbon concentration is always formed from the interior of the particle toward the surface thereof. And also, the interior of the particle is always heated by induction heating, so that carbon is forcedly diffused from the interior of the particle toward the surface thereof. Moreover, if the amount of alloyed carbon in the atomized powder is relatively deficient with respect to the oxygen content, the deficient amount may be supplemented with graphite granule likewise the case of the rough reduced iron powder.

Furthermore, although the particles of the powder contain the reducing agent and act as a heat generator according to the reduction process of the invention, the source of the reducing agent and the heating source are independently separated from each other. On the other hand, in the conventional gas reduction system, heat for heating the powder is first given to the reducing gas from an external heating source and then changed from the reducing gas to the powder except for the use of radiant heat. That is, the conventional gas reduction system is an indirect heating system wherein the heating source and the reducing agent are present outside the particles and in this case the reducing gas itself also serves as a heat carrier for heating the powder. In this point, the invention is different from the conventional gas reduction system.

The invention will be described in greater detail below.

The iron-base metallic raw powder to be subjected to final reduction according to the invention includes iron-base powder materials obtained in an unfinished reduction state by a well-known method such as pure iron powder for powder metallurgy, alloy steel powder or iron alloy powder containing an alloying element and the like. For instance, there are sheet-like iron deposited on a cathode by electrolysis; rough reduced cake or sponge iron by reduction and pulverized products thereof; atomized powder by atomization; pounded powder by a mechanical pulverizing method and the like. Furthermore, according to the invention, commercially available final products obtained by subjecting to the conventional final reduction can also be used. Because, these final products are not always low-oxygen powder and particularly the product having a higher oxygen content is obtained from a hardly reducible powder. And also, even in the commercially available pure iron powder, the oxygen content is 1,000–5,000 ppm and is usually 10 to 100 times higher than that of the ingot steel.

The iron-base metallic raw powder to be used in the invention must satisfy the particle size of not more than 1 mm, the apparent density in filled state corresponding to 16–57% of theoretical true density and the oxygen content of not more than 6% by weight as apparent from the followings.

According to the invention, it is necessary to rapidly promote the diffusion of carbon in the starting powder from the interior of the particles toward the surface thereof by the induction heating. Therefore, the particle size of the powder should be made small as far as possible. From this fact, the particle size is preferably not more than 1 mm. By shortening the average diffusion distance of carbon, the necessary deoxidation time in the induction heating, i.e. the heating time of the powder can be shortened and also the excessive sintering of the resulting I-cake is prevented and as a result, the pulverizability of I-cake is retained in good condition.

Furthermore, the factor for retaining the pulverizability of I-cake in good condition is a sintering density of I-cake, which is closely related to the density of the starting powder. According to the invention, the preheating and sintering step of the starting powder is indispensable as apparent from the following. The higher the density of P-cake produced in this step, the higher the sinter strength of I-cake and as a result, the pulverizability of I-cake is gradually deteriorated. On the contrary, when the density of P-cake is low, the pulverizability of I-cake is retained in good condition. However, if the density of P-cake is too low, the sinterability of P-cake in the preheating step becomes poor, so that when P-cake is heated by the induction heating at the subsequent step, it collapses due to the load applied from the top and consequently impurities are included into the powder by contacting P-cake with a refractory lining wall of an induction heating furnace and also the efficiency of the induction heating lowers. That is, when the P-cake collapses or cracks, the eddy current by the induction heating is wastefully consumed and does not contribute to the heating effectively. Furthermore, the eddy current concentrates in the cracks and the like to cause a local heating, whereby the powder is locally melted and the sintering proceeds excessively. Thus, the pulverizability of I-cake depends upon the density of P-cake, which is governed by an apparent density of the powder in filled state. The upper and lower limits of the apparent density of the powder in filled state are 57% and 16% of the theoretical true density, respectively, based on the above mentioned facts and experimental results. When the apparent density is within such a range, the desired density of P-cake is achieved so that the excessive sintering of I-cake is prevented and the pulverizability thereof is also retained in good condition.

The filling of the iron-base metallic raw powder is carried out by gravity filling, compression filling under a pressure of not more than 1 t/cm$^2$ for improving the filled state without compacting, tap filling and the like, but in any case, the apparent density must satisfy the above range.

The oxygen content of the iron-base metallic raw powder must be 6% by weight at maximum on the one hand in order to shorten a time required for the formation of P-cake at the preheating and sintering step, i.e. the time required for sintering the starting powder to provide a certain strength, and on the other hand in order to prevent the excessive sintering of I-cake as far as possible by shortening a time required for deoxidation and decarburization reaction at the induction heating step. Therefore, in the preparation of the starting powder, the oxygen content is necessary to be limited to not more than 6% by weight.

Even if the oxygen content of the starting powder exceeds 6% by weight, the process of the invention is applicable. However, when such powder is subjected to final reduction, not only the preheating and sintering step requires a long time, but also the deoxidation and decarburization reaction by the induction heating takes a relatively long time, so that the productivity lowers and the sintering of I-cake proceeds excessively and hence the pulverizability of I-cake is lost. Accordingly, the oxygen content of the starting powder is preferably not more than 6% by weight.

In general, oxygen is existent in the starting powder as oxide and/or hydroxide or composite thereof. Among them, the oxygen compounds having a dissociated oxygen partial pressure of not less than $10^{-39}$ atmospheric pressure above 850° C. can be reduced by the process of the invention. For instance, FeO, MnO, $Cr_2O_3$, $SiO_2$ and the like are easily reduced. On the contrary, the oxides (inclusive of hydroxides) having a dissociated oxygen partial pressure of less than $10^{-39}$ atmospheric pressure above 850° C. are partly reduced by the process of the invention, but cannot completely be reduced. However, even if a small amount of these unreducible oxides is existent in the starting powder, the process of the invention can be effected without difficulties.

Moreover, the oxygen content of the starting powder can be adjusted. For instance, the oxygen content can be adjusted by changing the temperature and time at the primary rough reduction step in case of the reduced iron powder or by maintaining the atomizing chamber under inert or neutral gas atmosphere in case of the atomized iron powder.

According to the invention, the starting powder contains carbon and/or carbonaceous granule to be alloyed in or admixed with the iron-base metallic raw powder in an amount corresponding to not more than an target alloying carbon content in a final product (% by weight)+an oxygen content of the powder just before the final reduction (% by weight)×1.35 as a reducing agent. Therefore, it is desirable to previously alloy the carbon in the iron-base metallic raw powder in the above defined amount. In some methods of producing the starting powder, however, the previous alloying of carbon may be difficult. In this case, the process of the invention can be effected after admixed with the carbonaceous granule such as graphite and the like. A part of the carbon admixed with the starting powder reacts with oxygen of the powder at the preheating step to effect deoxidation, but the remainder is carburized and alloyed in the particles of the powder during the preheating. The thus alloyed carbon acts as the reducing agent to effectively conduct the deoxidation and decarburization reaction at the subsequent induction heating step.

As the carbonaceous granule, there are conveniently used granules having a particle size of not more than 150 μm, preferably not more than 44 μm and containing a fixed carbon of not less than 95%. When the particle size exceeds 150 μm, the reaction velocity becomes slow and the function as the reducing agent is deteriorated. And also, when the fixed carbon is less than 95%, impurities in the finally reduced powder increase. In stead of the carbonaceous granules, an organic powder, an oil and the like can also be used, but various problems are caused in a continuous operation apparatus as mentioned below, so that the use thereof is not preferable in practice.

According to the invention, it is confirmed from the experiments that the carbon content directly serving for deoxidation is 1.35 times higher than the oxygen content of the starting powder at maximum. Thus, it is desired that carbon acting as the reducing agent is previously alloyed in the starting powder as mentioned above. This fact will be explained below with respect to the case of using water-atomized iron powder as the starting powder.

(I) When carbon is alloyed in the particles of the starting powder, local fusing of I-cake during the induction heating or over-sintering between the particles by fusing surfaces of the particles can be prevented and hence the excessive sintering of I-cake can be prevented. As a result, the pulverizability of I-cake is easy to be maintained in good condition.

(II) There is not caused a segregation phenomenon of carbon during the transportation of the powder different from the case of admixed carbon.

(III) By adding carbon to molten steel, the solidification point of the molten steel is lowered, so that the smelting temperature can be lowered and the life of the refractory used in the furnace can be prolonged. Furthermore, the clogging of nozzles of molten bath during the atomization can be prevented due to the decrease of viscosity of molten bath and beside this the decrease of unit amount of heat is expected. As a result, it is easy to produce alloy powder which contains an element such as Cr or the like increasing the viscosity of molten bath.

(IV) Since the oxidation of the molten bath can be prevented during smelting, the solution yield of the alloying element such as Si, Mn, Cr and the like is improved and at the same time the oxidation of the powder can be prevented during the water atomization.

Heretofore, there has been seen from the above mentioned fourth reason that the water atomization is effected after carbon is added to molten steel. In this case, however, the conventional hydrogen gas reduction system is adopted as the final reduction, so that there is caused a troublesome problem. That is, when using a dry hydrogen having a low dew point, the deoxidation proceeds to a certain extent, but the decarburization cannot be effected, so that powder containing a large amount of carbon is obtained. Such powder is extremely inferior in the compressibility and formability and is impossible to be used for powder metallurgy. On the other hand, when using a wet hydrogen having a high dew point, the decarburization is sufficient, but the deoxidation becomes insufficient, so that it is difficult to obtain a low-oxygen powder. For these reasons, there has hitherto been avoided that the atomization is effected after the addition of carbon to molten steel.

On the contrary, according to the invention, the alloyed carbon in the starting powder is positively utilized and there is adopted a reduction system wherein the alloyed carbon is used as a reducing agent alone or as a main reducing agent. Furthermore, the reduction system using carbon according to the invention can provide a very favorable deoxidation as compared with the conventional gas reduction system. Then, the reduction system according to the invention will be described with the conventional hydrogen gas reduction system.

When a metal oxide is represented by a general formula MO, the reduction reactions with carbon and hydrogen can be described by the following reaction formulae, respectively.

$$MO + C \rightarrow M + CO \quad (1)$$

$$MO + H_2 \rightarrow M + H_2O \quad (2)$$

In the above formulae (1) and (2), when the material to be reduced is selected from FeO, $Cr_2O_3$, MnO and $SiO_2$, the relative difficulty of reduction is summarized in the following Table 1. In this table, there are shown a partial pressure of CO gas and a ratio of partial pressures of $H_2$ and $H_2O$ thermodynamically calculated from the change of free energy of the reaction, assuming that the reduction temperature is 1,350° C.

TABLE 1

| Relative difficulty of reduction with carbon or hydrogen gas (Reduction temperature 1,350° C.) | | |
|---|---|---|
| Oxide to be reduced | Reduction with C Partial pressure of CO gas (mmHg) | Reduction with $H_2$ $P_{H_2}/P_{H_2O}$ |
| FeO | $9.1 \times 10^5$ | 1.0 |
| $Cr_2O_3$ | $3.6 \times 10^3$ | $2.7 \times 10^2$ |
| MnO | $3.1 \times 10^2$ | $3.1 \times 10^3$ |
| $SiO_2$ | $5.8 \times 10$ | $1.7 \times 10^4$ |

As seen from the result of Table 1, the reduction with carbon is advantageous as compared with the reduction with hydrogen. Furthermore, it can be understood that the reduction system according to the invention can be carried out more effectively under vacuum. For instance, if it is intended to reduce $SiO_2$, the partial pressure of $H_2O$ gas should be not more than about 1/10,000 of the partial pressure of $H_2$ gas in the conventional hydrogen gas reduction system, while according to the invention, the reduction proceeds under vacuum of not more than about 10 mmHg. Moreover, the dissociated oxygen partial pressure of $SiO_2$ is $2.6 \times 10^{-19}$ atmospheric pressure at 1,350° C. and $1.4 \times 10^{-31}$ atmospheric pressure at 850° C., which is higher than the above defined $10^{-39}$ atmospheric pressure. The heating temperature of 1,350° C. can easily be realized by the induction heating method.

For the comparison, there will be described with respect to the case of subjecting the starting powder containing substantially no carbon to reduction with hydrogen during the induction heating. In this case, the particles of the powder are heated from the interior, but they do not contain the reducing agent such as carbon, so that the reduction rate is slow as compared with the case of using the powder containing carbon. That is, a certain time is required for penetrating hydrogen gas as the reducing agent into the powder filled layer and also the individual particle is reduced from the surface thereof, so that the reduction rate becomes considerably slow. For this reason, when the powder is heated at an elevated temperature such as 1,350° C., the sintering between the particles proceeds more, so that the pulverizability of the resulting I-cake is seriously deteriorated. As seen from this fact, according to the invention, it is important that the amount of carbon required for deoxidation is previously alloyed in the individual particle of the powder prior to the induction heating step. The starting iron-base metallic raw powder alloyed or to be alloyed with carbon obtained by any production method and having any alloy composition and mixtures thereof as mentioned above may be used in the process of the invention. Furthermore, there may be used an admixed powder of any combination of iron raw powder wherein metallic iron holds the first place on a basis of weight percentage (inclusive of alloy steel powder), a non-ferrous metallic powder (inclusive of simple substances and alloys) and a non-metallic powder (inclusive of simple substances and compounds).

As mentioned above, in the practice of the invention, it is important that the oxygen content of the starting powder and the carbon content previously alloyed and/or separately admixed are sufficiently adjusted as far as possible. For example, in the production of the powder wherein the carbon content must be limited to less than 0.1%, preferably not more than 0.01% as in the case of pure iron powder widely used for powder metallurgy but the oxygen content is more than 0.5% in practical use, the adjustment of the carbon content and oxygen content of the starting powder should be effected aiming at that the carbon content of the final product powder is lowered as far as possible. On the contrary, in the production of the powder wherein the oxygen content must be limited to a value as low as possible, for example, not more than 0.1% as in the case of the alloy steel powder for sinter-forging and packed powder forging but the carbon content is sufficient to be substantially equal to the target alloying carbon content in the densified material, so the process of the invention must be effected so as to accomplish the sufficient deoxidation after the carbon content is previously adjusted so that the target carbon content is retained in the final product powder. Moreover, the oxygen content of the starting powder can be adjusted, for example, by adjustments of atmosphere and water level during atomization, adjustments of dewatering and drying conditions after the atomization and the like in case of water-atomized iron powder and by properly selecting the water content and drying condition of water exposure method in addition to the change of the rough reduction condition in case of the rough reduced iron powder. Thus, according to the invention, it is important that the starting powder is subjected to an appropriate preliminary treatment in compliance with the purpose.

According to the invention, in order to produce a low-oxygen iron-base metallic powder having an oxygen content of not more than 0.5% by preheating the starting powder previously adjusted as mentioned above and then deoxidizing and decarburizing by an induction heating, the non-oxidizing atmosphere must be retained in such a state that the thermodynamically calculated oxygen partial pressure is not more than $2.1\times10^{-1}$ mmHg and the dew point is not more than +5° C.

In the process of the invention including the preheating step, the higher the temperature of the induction heating the larger the formation and hence the amount of CO gas, so that the reoxidation of I-cake can be prevented during the high temperature heating. On the other hand, when the temperature is relatively low, the ratio of $CO_2$ in the waste gas increases and also the thermodynamically calculated oxygen partial pressure becomes high, so that I-cake is apt to be reoxidized. That is, when the thermodynamically calculated oxygen partial pressure and dew point are more than $2.1\times10^{-1}$ mmHg and +5° C., respectively, the reoxidation of I-cake is caused during the course of the reduction, so that the low-oxygen powder cannot be obtained. Therefore, in order to prevent the reoxidation of I-cake and to effectively conduct the deoxidation, it is preferable that the whole step of the process is maintained in the non-oxidizing atmosphere by limiting the thermodynamically calculated oxygen partial pressure and dew point to not more than $2.1\times10^{-1}$ mmHg and +5° C., respectively.

Such non-oxidizing atmosphere satisfying the above mentioned requirements includes a neutral gas, an inert gas, a reducing gas atmosphere, a vacuum and the like. Among them, the use of the vacuum is preferable judging totally from the deoxidation efficiency, the pulverizability and prevention of reoxidation of I-cake, the handling convenience, economy and the like.

In order to produce the final product powder having an oxygen content of not more than 0.18% by weight by the process of the invention, it is necessary that the carbon content required for the deoxidation is made to not less than the oxygen content (%) of the starting powder ×0.35 and further that the thermodynamically calculated oxygen partial pressure and dew point of the atmosphere at the cooling step of I-cake after the induction heating are controlled more severe. In practice, it has been confirmed that when the I-cake is cooled below 850° C., the thermodynamically calculated oxygen partial pressure and dew point must be made to not more than $2.1\times10^{-2}$ mmHg and −10° C., respectively. Otherwise, the absolute amount of CO gas produced from the I-cake considerably decreases and also the ratio of CO gas in the waste gas lowers and further the cooling at lower temperature, particularly below 600° C. takes a long time and as a result, the I-cake is reoxidized by a very small amount of oxygen or moisture present in the atmosphere, so that it is impossible to produce the low-oxygen powder.

Thus, according to the invention, it is very important to control the thermodynamically calculated oxygen partial pressure (inclusive of oxygen partial pressure calculated in a mixed gas of $H_2$ and $H_2O$ or of CO and $CO_2$) and dew point in the non-oxidizing atmosphere.

The starting powder is preheated at a temperature of 780°-1,130° C. in the non-oxidizing atmosphere of the above defined conditions for 5-335 minutes to form a preheated and sintered cake (P-cake).

The preheating step fundamentally aims at the sintering of the starting powder and does not aim to conduct the final reduction by deoxidation. Therefore, the lower limit of the preheating temperature is 780° C. of a lowest temperature required for the sintering and the upper limit thereof is 1,130° C. in order to prevent the fusing or excessive sintering of the starting powder, particularly powder having an alloying carbon amount of more than about 1.8%, powder admixed with the carbonaceous granule or the like.

It has been found from the results of many experiments that the preheating time (i.e. retention time) is a function of the preheating temperature. That is, the lower limit of the preheating time is a time required for imparting a certain strength to the resulting P-cake, i.e. a lowest time required for rendering P-cake from the surface toward the depth of more than about 5 mm to a sintered state, and is, of course, dependent upon the preheating temperature. When the preheating temperature (T) is within the above range, the lower limit of the preheating time is expressed by the following equation:

$$t = \frac{1{,}750}{T_p - 1{,}030} \text{ (min.)}$$

wherein $T_p$ is an absolute temperature. For instance, when T is 1,130° C., t is 5 minutes. Moreover, the sintering of the powder and the alloying of carbon are caused after the deoxidation and decarburization proceed to a certain extent, so that the lower limit of the preheating time is required for effecting the preliminary deoxidation and decarburization. On the other hand, the upper limit of the preheating time is required for preventing the excessive sintering of P-cake and expressed by the following equation:

$$t = 5.88 \times 10^{-4} \times e^{\frac{14{,}100}{T_p}} + \frac{42{,}100}{T_p - 300} \text{ (min.)}$$

For instance, when T is 780° C., t is 335 minutes. When the preheating time exceeds the upper limit, the productivity and heat economy at the preheating step are poor, which have a bad influence upon the pulverizability of I-cake produced at the subsequent induction heating step.

The starting powder may be directly heated by the induction heating without the preheating step according to the invention. This fact has been already proposed by the inventors in Japanese Patent laid open No. 145,943/75 and No. 1,353/76.

The invention is to more efficiently conduct the final reduction of the starting powder by adding the preheating step to the already proposed arts. Such preheating step plays an important part as mentioned below.

(1) When the starting powder is preheated to form a sintered cake, the subsequent induction heating can be effected at higher temperature without contacting the powder with the refractory and the like of the furnace and consequently the contamination of the deoxidized powder (product powder) with the refractory can be prevented. Further, the resulting P-cake can be heated at the subsequent induction heating step without any contact, so that the induction heating temperature can be raised as far as possible.

(2) Upon the preheating, the starting powder is sintered into a cake and at the same time the heat is previously given to the resulting P-cake, so that the temperature rising time at the induction heating step can be more shortened. Further, such preheating can prevent the generation of cracks and the local fusing in the P-cake accompanied by rapidly raising the temperature at the induction heating step. For instance, when the completely cooled P-cake is directly heated from room temperature to an elevated temperature at the induction heating step, if the temperature rising rate becomes faster, the cracks are apt to be generated in the P-cake due to thermal stress and transformation-induced stress, so that the P-cake is desired to be in the preheated state prior to the induction heating. If the cracks are generated in the P-cake, the cracked portions are locally fused at the induction heating step so that the pulverizability of the resulting I-cake is deteriorated and at the same time the yield of the product powder is also lowered.

(3) The deoxidation and decarburization of the starting powder are previously promoted by the preheating, so that the necessary deoxidation time at the induction heating step can be shortened and also the excessive sintering of I-cake can be prevented.

(4) In case of using the starting powder previously admixed with the carbonaceous granule, the preheating step is particularly necessary for preliminarily effecting the deoxidation with carbon and alloying the carbon in the starting powder. Further, such alloying can prevent micro-fusing phenomenon or excessive sintering of I-cake.

Next, the P-cake having a certain strength is passed through an induction heating step maintained in the non-oxidizing atmosphere, where the P-cake is subjected to final reduction by induction heating at a temperature of 850° C.–1,400° C. for not more than 321 minutes while applying an alternating power of 50 Hz–500 kHz from power supply to form an induction heated cake (I-cake). In this case, an induction eddy current is induced in the particles of the P-cake to generate the heat from the interior of the particles, whereby the diffusion of alloyed carbon in the particles is promoted and the deoxidation and decarburization reaction proceeds in a very short time to complete the final reduction.

Namely, in order to conduct the deoxidation efficiently and effectively, the induction heating temperature must be 850° C. at minimum and the heating above this temperature is preferable. At the temperature of less than 850° C., the deoxidation takes a long time and at the same time the effective deoxidation cannot be accomplished. On the other hand, when the heating temperature exceeds 1,400° C., even if the heating time is shortened, the sintering is more promoted to render the resulting I-cake in an excessive sintered state or a local fused state, so that the pulverizability of I-cake is lost considerably. Therefore, the upper limit of the heating temperature must be 1,400° C. Moreover, it is a matter of course that the induction heating temperature should be determined within the above range considering from the melting point of the starting powder.

The upper limit of the heating time (retention time) at the induction heating step is determined considering from the effective accomplishment of deoxidation and the pulverizability of I-cake and is a function of the heating temperature likewise the case of the preheating step. In the case of the conventional gas reduction system, the sufficient deoxidation of the powder is usually accomplished by prolonging the retention time at a given reduction temperature, but the sintering is inversely promoted and the pulverizability of the sintered cake is obstructed. Therefore, the upper and lower limits of the retention time in the conventional gas reduction system are determined considering from both the pulverizability and the deoxidation. On the contrary, according to the invention, the sufficient deoxidation is substantially completed just before the pulverizability of I-cake rapidly begins to lower. Therefore, it is sufficient to control only the upper limit of the retention time. It has been found out from the results of various experiments that the upper limit of the retention time is sufficiently within a range of the following equation:

$$t = 19 + 3.9 \times 10^{-7} \times e^{\frac{22,200}{T_I}} \text{ (min.)}$$

wherein T is an induction heating temperature and $T_I$ is an absolute temperature. For instance, when T is 850° C., t is 321 minutes.

The reason why the frequency used in the induction heating step is limited to 50 Hz–500 kHz will be explained below. According to the invention, the starting powder is preheated to form P-cake and then the resulting P-cake is subjected to an induction heating. That is, the heating system of the invention is different from the system of directly induction heating the starting powder as proposed in Japanese Patent laid open No. 1,353/76. Therefore, the frequency to be used depends upon the apparent density of P-cake rather than the oxygen content of the powder. Consequently, it is necessary to select the frequency suitable for the apparent density of P-cake. For example, when the apparent density of P-cake is 16% of the theoretical true density or corresponds to the lowest value in the starting powder, the frequency is necessary to be 50 Hz at minimum. At the frequency of less than 50 Hz, the efficient heating is impossible. On the other hand, when the apparent density of P-cake is 57% corresponding to the highest value in the starting powder, the frequency is sufficient to be 500 kHz at maximum. At the frequency of more than 500 kHz, only the superficial portion of P-cake is heated and the heat soaking to the center portion cannot be achieved. From these reasons, the frequency to be used in the invention is limited to a range of 50 Hz–500 kHz. Moreover, the best result can be obtained within a range of 500 Hz–10 kHz.

Although it is desirable that the temperature rise at the induction heating step is carried out in a short time as far as possible, if the rapid heating is too large, cracks are generated in the resulting I-cake due to thermal stress and transformation-induced stress, so that it is important to select an adequate temperature rising rate. This rate can be adjusted by properly selecting the induction heating temperature and time and the frequency.

Thus, the induction heating is an essential feature of the invention and has the following merits as compared with the conventional gas reduction system.

(I) In the induction heating system, the temperature of the powder itself can be raised as compared with the prior art using an indirect heating system. In the conventional indirect heating system, metal is used in main parts of the heating furnace such as a core tube, a retort, a hearth roller, a belt, a tray and the like, so that the industrially realizable maximum heating temperature is about 1,100° C. According to the invention, no metal is used in the induction heating part except for a water-cooled heating coil as mentioned below and also the P-cake is directly induction heated without contacting with anything, so that it is possible to raise the heating temperature up to a fusing temperature of the resulting I-cake.

(II) Upon direct heating due to the induction eddy current, the temperature of P-cake can be rapidly raised up to an elevated temperature and it is possible to heat soak the cake to the center portion thereof in a short time. Thus, the deoxidation and decarburization reaction rapidly occurs and is promoted, so that the necessary deoxidation time is considerably shortened and the excessive sintering of I-cake is prevented. As a result, the pulverizability of I-cake is retained in good condition. Owing to the rapid temperature rise, the interior of the particle such as pearlite portion and the like is heated up to a high temperature austenitic state with a high carbon concentration, so that the rapid deoxidation and decarburization reaction is liable to be caused. In any case, the induction heating system according to the invention is very fast in the deoxidation rate and good in the reduction efficiency as compared with the gas reduction system, i.e. the indirect heating system using a resistance heating element or a gas or a heavy oil. Furthermore, the reduction percentage is excellent and the very effective deoxidation can be accomplished. Because, the particles are heated from the interior thereof and the heat is forcedly generated, so that the diffusion of carbon is promoted.

(III) In the induction heating system, it is not necessary to provide a useless space on the apparatus as compared with the gas reduction system, so that it is possible to compact the apparatus. As a result, it is possible to reduce the area of the structure housing the apparatus.

Next, the thus obtained I-cake is cooled to a temperature enough to effect pulverizing and then pulverized to obtain a low-oxygen iron-base metallic powder. In this cooling step, it is preferable that the above mentioned nonoxidizing atmosphere is retained in order to prevent the reoxidation of I-cake. The cooled I-cake may be pulverized by any of well-known methods.

According to the invention, the shapes of P-cake and I-cake are usually a column or a hollow cylinder and may be a square or a triangle in compliance with the use. Moreover, the sectional dimension of the cake may be properly determined considering from the productivity and use.

According to the invention, powder having a lower oxygen content can be obtained by repeating the procedure of the induction heating and cooling step. However, the deoxidation percentage gradually lowers every the repeating of such procedure, while the sintering of I-cake is promoted, so that the pulverizability of I-cake is deteriorated. Furthermore, the process of the invention can be effected by admixing a part of the powder obtained by pulverizing the I-cake with the starting powder. In this case, the preheating time can be further shortened.

According to the invention, there is also provided an apparatus for producing low-oxygen iron-base metallic powder, which comprises means for feeding a starting powder composed of iron-base metallic raw powder to be subjected to a final reduction, which has an apparent density in filled state corresponding to 16–57% of theoretical true density, an oxygen content of not more than 6% by weight and a particle size of not more than 1 mm, and carbon or carbonaceous granule to be alloyed in and/or admixed with the iron-base metallic powder in an amount corresponding to not more than an target alloying carbon content of a final product (% by weight)+an oxygen content of the powder just before the final reduction (% by weight)$\times$1.35, a preheating and sintering device for preheating the starting powder from the feeding means to form a preheated and sintered cake (P-cake), an induction heating device for subjecting the P-cake to the final reduction by induction heating to form an induction heated cake (I-cake), a pushing member for transferring the starting powder from the feeding means to the preheating and sintering device, means for adjusting and maintaining at least interiors of the preheating and sintering device and the induction heating device in a non-oxidizing atmosphere having a thermodynamically calculated oxygen partial pressure of not more than $2.1\times10^{-1}$ mmHg and a dew point of not more than +5° C., means for cutting and cooling the I-cake and means for pulverizing the cooled I-cake.

By using the apparatus according to the invention, the low-oxygen iron-base metallic powder can be produced continuously or semicontinuously. The apparatus for industrially practicing the process of the invention is the vertical type for the following reasons:

(i) The starting powder has a fluidity, so that it is very convenient to fall the powder from top to bottom by gravity.

(ii) When the horizontal type apparatus is used, the powder and the sintered cake are distorted in a cross sectional direction and bend in a gravity direction and may contact with a part of the apparatus at the preheating step and the induction heating step, so that the handling is difficult. Further, the cross section of the sintered cake is not a true circle, so that the heat soaking property is considerably deteriorated. On the contrary, when the vertical type apparatus is used, the cross section of the cake becomes substantially circular and the density of the cake is uniform, so that the heat soaking property is considerably improved.

(iii) In the horizontal or inclined type apparatus, a large force is required for pushing the sintered cake toward a horizontal or inclined direction. On the other hand, in the vertical type apparatus, the sintered cake is pushed down in a vertical direction by gravity, so that the pushing of the cake is most reasonable.

Figure 2:
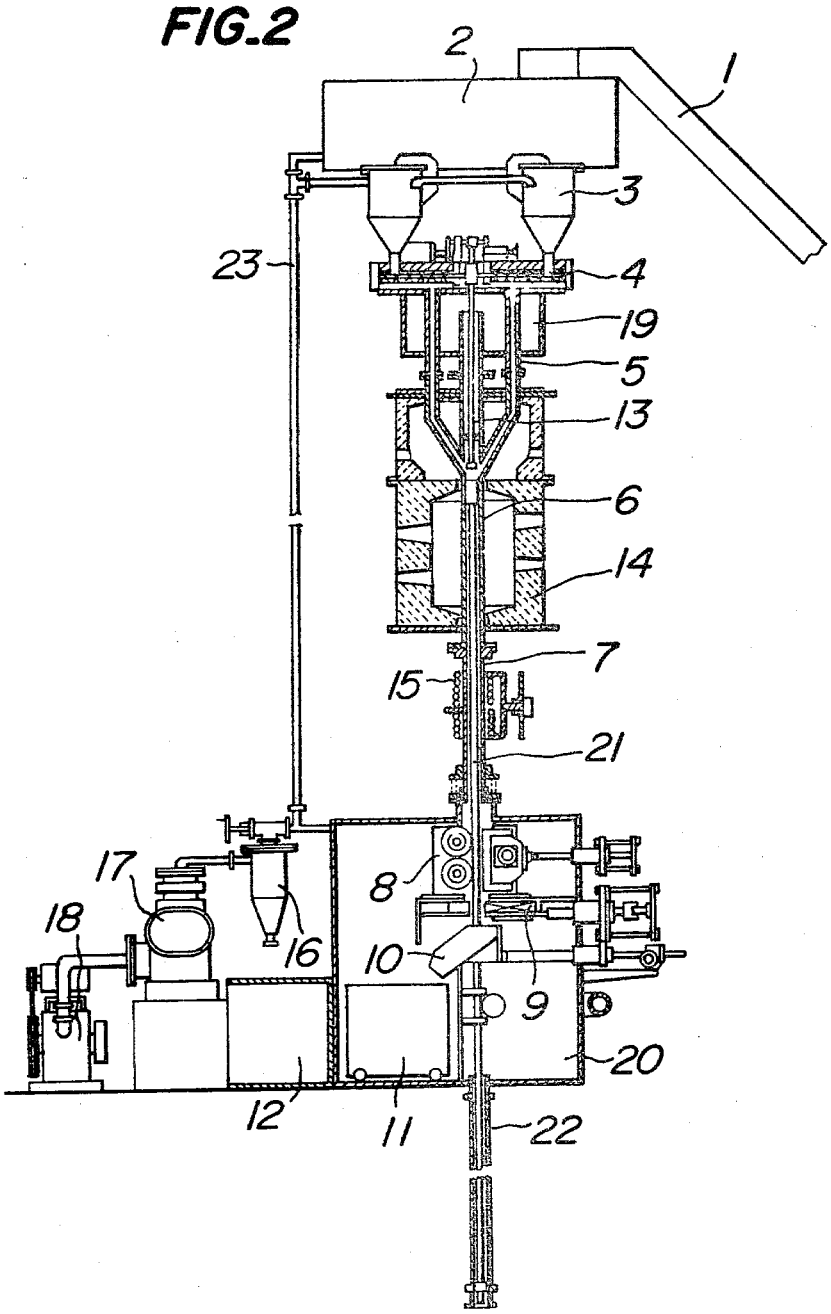
Figure 3:
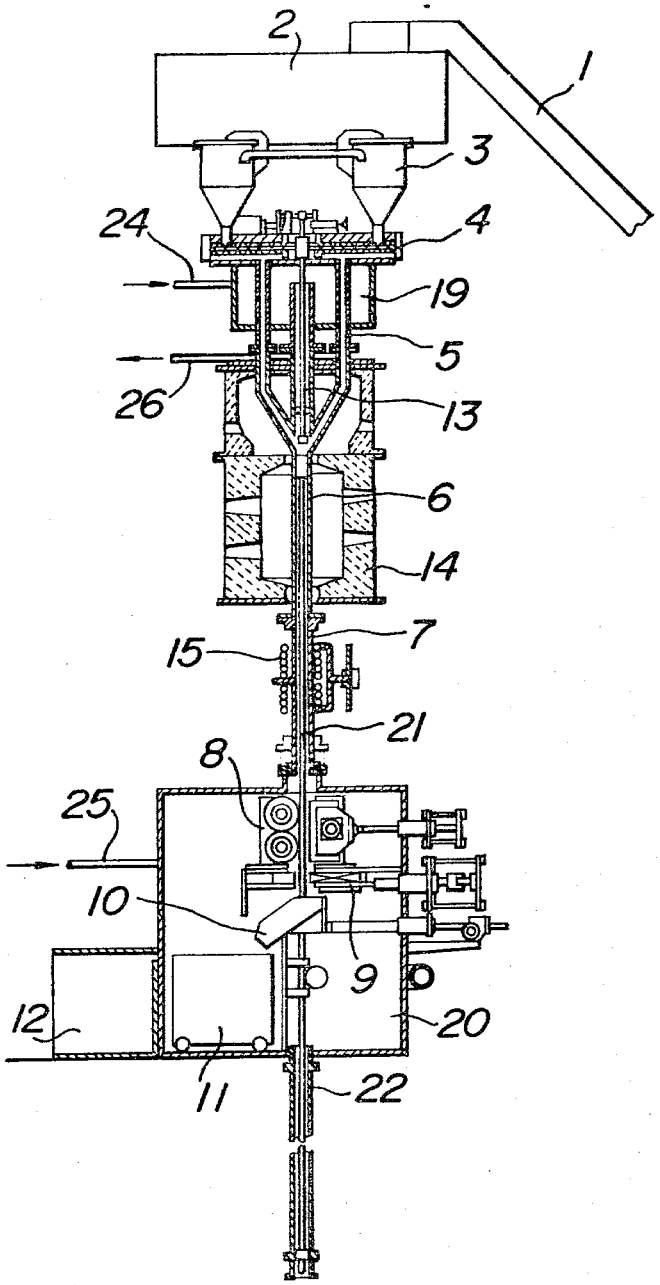

The invention will now be described in greater detail with reference to the accompanying drawings, wherein:

FIG. 1 is a schematic block diagram of an embodiment of the apparatus for practicing the process of the invention; and FIGS. 2 and 3 are schematically elevational views partly shown in section of embodiments of the apparatus for practicing the process of the invention, respectively.

Referring to FIG. 1, the outline of the vertical type apparatus according to the invention will be described as the flow of the material.

The starting powder is temporarily stored in a powder storage hopper B through a powder feeding device A and then intermittently charged into a preheating and sintering furnace D through a powder feeder C while controlling the feeding amount of the powder. In the preheating and sintering furnace D, the starting powder is gradually sintered, while being moved in a downward direction, to form a preheated and sintered cake (P-cake). The thus obtained P-cake is intermittently moved in a downward direction by means of a pusher K. The P-cake arrives at an induction heating furnace E within a temperature range of 400°–850° C. with some temperature drop, where the induction heating is started.

It is necessary that the downwardly moving velocity of P-cake is properly regulated depending upon the kinds of the starting powder, the carbon content and the oxygen content. In practice, this regulation is carried out by adjusting the feeding amount of the starting powder per unit time and the operation number and stroke distance of the pusher K. Further, the factor determining the downwardly moving velocity of P-cake is mainly related to the sinterability or sintering rate of the starting powder at the preheating and sintering step, the deoxidation and decarburization reaction rate at the subsequent induction heating step, and the pulverizability of the resulting I-cake. Therefore, the downwardly moving velocity of P-cake should be determined by taking the above mentioned factors into consideration. Moreover, the retention time at the preheating step is a time in which the starting powder passes through the preheating and sintering furnace D having a certain length and depends upon the downwardly moving velocity of the resulting P-cake.

The retention time at the induction heating step is a time in which the P-cake passes through an induction heating coil likewise the retention time at the preheating step. Since the length of the induction heating coil can be changed by the replacement of the coil, the retention times at the preheating step and the induction heating step can properly be matched with each other. Further, the matching of both the retention times can be satisfactorily effected by a combination of temperatures at the preheating step and the induction heating step.

In the apparatus according to the invention, the P-cake and I-cake are united with each other as a rod, so that the moving velocity of I-cake is the same as that of P-cake. That is, the movement of both the cakes is simultaneously carried out by means of the pusher K.

Then, the I-cake formed at the induction heating step is downwardly transferred into a cooling zone (F, G, H, I) and then temporarily stored in an I-cake storage tank after the I-cake is cut in a suitable length by a cutter G. In the storage tank H, the temperature of I-cake is usually within a range of 300°–850° C. If it is intended to prevent the reoxidation of I-cake as far as possible, the I-cake is rapidly transferred into a cooling chamber I through a transporting device L. In the cooling chamber I, the I-cake is sufficiently cooled to room temperature while severely controlling the thermodynamically calculated oxygen partial pressure and dew point.

Finally, the cooled I-cake is taken out from the cooling chamber by means of a take-up device J and then pulverized by a suitable pulverizing machine.

In the apparatus according to the invention, there are provided a dummy bar M, means F for holding and descending I-cake, a synchronous device O for synchronizing the dummy bar M or the means F with the pusher K, an atmosphere conditioning device N and the like, which are essential parts of the apparatus.

The dummy bar M is required only in the beginning of the operation, but comes into disuse during the continuous operation. Therefore, the dummy bar M is housed in the bottom portion of the apparatus during the continuous operation. When the starting powder is fed into the preheating and sintering furnace D in the beginning of the operation, it is necessary to prevent the downward falling of the starting powder and to hold the starting powder in the preheating and sintering zone. This is achieved by the dummy bar M. Therefore, the dummy bar M is designed so as to prevent the falling of the starting powder at the top portion and to intermittently descend at a given velocity while synchronizing with the synchronous device O by the pusher K in advance with the sintering of the starting powder, so that the growth and descending of P-cake is continued during the descending of the dummy bar. When the top portion of the dummy bar passes through the lower end of the induction heating coil, the induction heating is started from the bottom portion of P-cake. The dummy bar M further continues to descend, during which the bottom portion of the resulting I-cake is transferred from the induction heating coil into the cooling zone. When the bottom portion of I-cake passes through the device F for holding and descending the I-cake, this bottom portion is clamped by a guide roller of the device F. At this time, the dummy bar M is separated from the bottom portion of I-cake and descends to the lower housing at a stroke. Then, a chute or shutter is pushed out so as to close a hole located above the dummy bar M.

The I-cake clamped by the guide roll further continues to descend without gravity falling with the synchronous driving relation of the device F and the pusher K by the synchronous device O. As a result, the I-cake passes through the zone of the cutter G, where the I-cake is cut into a given length by the cutter G. Thereafter, the cut I-cake is thrown into the I-cake storage tank H through the chute and stored therein temporarily. In this way, the apparatus according to the invention begins to start the continuous operation and continues on-stream.

In the operation, the interior of the apparatus according to the invention is maintained in the non-oxidizing gas atmosphere or in vacuum by the atmosphere conditioning device N. As mentioned above, the apparatus according to the invention is often operated under vacuum, so that there is adapted to two-step exhaust mechanism composed of a mechanical booster or a steam ejector and a rotary pump as the device N. Furthermore, the device N is provided with a gas automatic change-over device including a deoxidation and dehumidification device, so that it makes possible to always select and change the gas atmosphere and vacuum. Moreover, there are arranged an accessory equipment P for the preheating and sintering furnace D, a power equipment for the induction heating furnace E, and various accessory equipments for measure, control, record, airtight seal, dust removal, maintenance, preservation and the like.

Then, the main parts constituting the apparatus according to the invention will be described with reference to FIGS. 2 and 3.

The powder feeding device A comprises a bucket conveyor 1 and a powder distributing and feeding tank 2, which can feed the starting powder into the apparatus while maintaining the atmosphere in a given condition. A numeral 3 represents a hopper temporarily storing the fed powder. Then, the stored powder is fed into a preheating and sintering zone by a screw feeder 4 through a branch pipe 5.

The preheating and sintering furnace D is constituted with a furnace body 14 and a metal reaction pipe 6 (usually made of stainless steel). As the preheating and sintering furnace, there are various types such as an electric resistance heating system, a gas or heavy oil burning system, and the like, but according to the invention the gas-burning system is adopted considering from the economy and the heating efficiency. The reaction pipe 6 may be made of any materials as far as the purpose is not obstructed, but it is desirable to select materials having a heat resistance, an oxidation resistance and an excellent heat conductivity.

The induction heating furnace E is constituted with a high airtight and non-induction refractory pipe 7 (usually made of quartz) and an induction heating coil 15.

A numeral 8 represents a guide roller for holding and descending I-cake, which is designed to cooperate with a pusher 13 by the synchronous device O. In this case, the guide roller is synchronized in such a manner that some compression stress is applied to I-cake, because when the tension stress acts on the I-cake, the any portion of P-cake located above the I-cake breaks off. Moreover, as the driving system of the pusher 13 there are two systems of oil pressure type and mechanical type. According to the invention, both the systems are adopted because it is necessary to freely adjust the stroke, pushing pressure and pushing velocity.

A numeral 9 is a cutter for cutting I-cake and a numeral 10 is a chute or shutter. The chute 10 is retreated in the beginning of the operation, during which a dummy bar 21 is pushed upwardly from a housing 22 and then inserted into the preheating and sintering furnace D. Therefore, it is desired that the top portion of the dummy bar is made from a metal having the same heat resistance as in the reaction pipe 6.

The cut I-cake is dropped into an I-cake storage tank 11 through the chute 10 and then transferred into a cooling chamber 12.

An upper tank 19 and a lower tank 20 are communicated with each other through a conduit 23 in such a manner that the interiors of both the tanks are maintained in the same atmosphere.

All of portions bearing thermal load, such as connection between the reaction pipe 6 and the refractory pipe 7, connection between the upper tank 19 and the branch pipe 5 or the reaction pipe 6, connection between the lower tank 20 and the refractory pipe 7 and the like are water cooled and are designed to be able to retain the interior of the apparatus in an airtight state. Furthermore, various members are used for detachably mounting the reaction pipe 6, the refractory pipe 7, the induction heating coil 15 and the like and for absorbing the thermal expansion of the reaction pipe 6 and the refractory pipe 7 during the heating, but they do not constitute the essential part of the invention, so that detail explanations with respect to these members are omitted herein.

When the apparatus of the invention is operated under vacuum as shown in FIG. 2, the interior of the apparatus is exhausted through a dust catcher 16 by a mechanical booster 17 and a rotary pump 18. Furthermore, when the apparatus of the invention is operated in a non-oxidizing gas atmosphere as shown in FIG. 3, the non-oxidizing gas is flowed into the interior of the apparatus through an upper conduit 24, a lower conduit 25 and an exhaust pipe 26.

The apparatus of the invention can be operated by any one of fully-automatic, semi-automatic and manual systems and makes it possible to attain a continuous or semi-continuous run.

The following examples are given in illustration of this invention and are not intended as limitations thereof.

EXAMPLES

A chemical composition of starting powders to be subjected to final reduction is shown in the following Table 2.

TABLE 2

| Starting powder | C | Si | Mn | P | S | Cr | Mo | O | Method of producing powder |
|---|---|---|---|---|---|---|---|---|---|
| Mn—Cr—Mo series low alloy steel powder (A) | 0.72 | 0.028 | 0.84 | 0.011 | 0.008 | 1.22 | 0.24 | 0.86 | Water atomization (atomized powder) |
| Pure iron powder (B) | 0.31 | 0.030 | 0.29 | 0.007 | 0.006 | — | — | 1.32 | Reduction method (rough reduced iron powder) |
| Pure iron powder (C) | 0.15 | 0.025 | 0.28 | 0.009 | 0.007 | — | — | 0.82 | Reduction method (rough reduced iron powder) |

The starting powder (A) is produced by atomizing water to an Mn-Cr-Mo series low alloy steel melted at 1,610° C. under 150 atmospheric pressure and then dewatering and infrared-drying the resulting alloy powder. The starting powders (B) and (C) are so-called rough reduced iron powders obtained by reducing mill scale with coke to form sponge iron, respectively. Moreover, the reduction temperature is 1,100° C. in case of the powder (B) and 1,140° C. in case of the powder (C). The apparent density and particle size distribution of these starting powders are shown in the following Table 3.

TABLE 3

| Starting powder | Apparent density (g/cm$^3$) | Density ratio (%) | Particle size distribution (%) | | | | | | |
|---|---|---|---|---|---|---|---|---|---|
| | | | +80 | 80~100 | 100~150 | 150~200 (mesh) | 200~250 | 250~325 | −325 |
| Mn—Cr—Mo series low alloy steel powder (A) | 2.90 | 36.9 | 0 | 0 | 22.1 | 24.6 | 6.8 | 19.4 | 27.1 |
| Pure iron powder (B) | 2.51 | 31.9 | 0.1 | 6.3 | 29.2 | 21.9 | 11.6 | 14.7 | 16.2 |

TABLE 3-continued

| Starting powder | Apparent density (g/cm³) | Density ratio (%) | Particle size distribution (%) +80 | 80~100 | 100~150 | 150~200 (mesh) | 200~250 | 250~325 | −325 |
|---|---|---|---|---|---|---|---|---|---|
| Pure iron powder (C) | 2.57 | 32.7 | 0 | 4.4 | 27.6 | 22.3 | 13.2 | 12.8 | 19.7 |

These starting powders are subjected to final reduction under reducing conditions as shown in the following Table 4 to obtain low-carbon iron-base metallic powders.

TABLE 4

| Experiment No. | Starting powder | Atmosphere condition: Atmosphere | Thermodynamically calculated oxygen partial pressure (mmHg) | Dew point (°C.) |
|---|---|---|---|---|
| 1 (Present invention) | (A) | Vacuum<br>Vacuum degree: $7.2 \times 10^{-2}$ mmHg | $1.51 \times 10^{-2}$ | — |
| 2 (Present invention) | (A) | Vacuum<br>Vacuum degree: $7.2 \times 10^{-2}$ mmHg | " | — |
| 3 (Present invention) | (A) | Neutral gas: $N_2$ + 3% $H_2$<br>Gauge pressure: 0.1 atm | $<10^{-3}$ | −20 |
| 4 (Present invention) | (A) | Inert gas: Ar<br>Gauge pressure: 0.1 atm | " | −40 |
| 5 (Present invention) | (A) | Reducing gas: $H_2$<br>Gauge pressure: 0.1 atm | " | $<-50$ |
| 6 (Prior Art) | (A) | Reducing gas: $H_2$<br>Flow rate: 2l/min | " | " |
| 7 (Present invention) | (B) | Vacuum<br>Vacuum degree: $1.4 \times 10^{-1}$ mmHg | $2.94 \times 10^{-2}$ | — |
| 8 (Present invention) | (C) | Vacuum<br>Vacuum degree: $9.1 \times 10^{-2}$ mmHg | $1.91 \times 10^{-2}$ | — |

| Experiment No. | Starting powder | Reducing condition: Preheating | Induction heating | Electric Resistance heating | Cooling condition |
|---|---|---|---|---|---|
| 1 (Present invention) | (A) | 1050° C. × 30 min | 1310° C. × 10 min | — | Same atmosphere as in the reduction |
| 2 (Present invention) | (A) | " | " | — | Atomizing pure hydrogen when the temperature of I-cake reaches to 600° C.<br>$P_{O_2} < 10^{-3}$ mmHg<br>D.P. < −50° C. |
| 3 (Present invention) | (A) | " | " | — | Same atmosphere as in the reduction |
| 4 (Present invention) | (A) | " | " | — | Same atmosphere as in the reduction |
| 5 (Present invention) | (A) | " | " | — | Same atmosphere as in the reduction |
| 6 (Prior Art) | (A) | — | — | 1150° C. × 5 hr | Same atmosphere as in the reduction |
| 7 (Present invention) | (B) | 980° C. × 30 min | 1200° C. × 10 min | — | Same atmosphere as in the reduction |
| 8 (Present invention) | (C) | " | " | — | Same atmosphere as in the reduction |

In Table 4, the process of the invention is applied to Experiments Nos. 1–5 using the starting powder (A), Experiment No. 7 using the starting powder (B) and Experiment No. 8 using the starting powder (C), respectively. For comparison, there is shown the prior art, i.e. the reduction of the starting powder (A) with hydrogen gas in Experiment No. 6.

In each Experiment according to the invention, the frequency used for the induction heating was 8.3 kHz and there was used the vertical type apparatus having an overall height of about 6 m above the floor level as shown in FIG. 2. The deoxidation was continuously carried out by using this apparatus and also gas-burning system was adopted to the preheating and sintering furnace. On the other hand, a batch-type and large-sized hydrogen annealing furnace was used in the prior art of Experiment No. 6.

The carbon content and oxygen content of the starting powder and the product powder after the final reduction are shown in the following Table 5. Further, the apparent density and particle size distribution of the product powder and green density at a compacting pressure of 5 t/cm$^2$ are shown in the following Table 6. Moreover, the following Table 7 shows the hardenability and mechanical properties of steel materials having a density ratio of 100%, which are obtained by sinter-forging the product powder of each of Experiments No. 2 and No. 6.

TABLE 5

| Experiment No. | Kind of Starting powder | Starting powder C (%) | Starting powder O (%) | Amount of graphite granule added (%) | Total carbon content (%) | Product powder after the final reduction C (%) | Product powder after the final reduction O (%) | Weight ratio ΔC/ΔO* | Reduction plan: Target carbon content in product powder (%) | Reduction plan: Weight ratio of the carbon content for deoxidation to the oxygen content of starting powder |
|---|---|---|---|---|---|---|---|---|---|---|
| 1 | (A) | 0.72 | 0.86 | 0 | 0.72 | 0.12 | 0.083 | 0.772 | 0.15 | 0.66 |
| 2 | (A) | 0.72 | 0.86 | 0 | 0.72 | 0.15 | 0.025 | 0.683 | 0.15 | 0.66 |
| 3 | (A) | 0.72 | 0.86 | 0 | 0.72 | 0.13 | 0.089 | 0.765 | 0.15 | 0.66 |
| 4 | (A) | 0.72 | 0.86 | 0 | 0.72 | 0.14 | 0.054 | 0.720 | 0.15 | 0.66 |
| 5 | (A) | 0.72 | 0.86 | 0 | 0.72 | 0.12 | 0.036 | 0.728 | 0.15 | 0.66 |
| 6 | (A) | 0.72 | 0.86 | 0 | 0.72 | 0.46 | 0.248 | 0.425 | — | — |
| 7 | (B) | 0.31 | 1.32 | 1.28 | 1.59 | 0.008 | 0.211 | 1.43 | <0.01 | 1.20 |
| 8 | (C) | 0.15 | 0.82 | 0 | 0.15 | 0.006 | 0.433 | 0.372 | " | 0.17 |

*ΔC: Decarburization amount from the starting powder by the finish reduction (%)
ΔO: Deoxidation amount from the starting powder by the finish reduction (%)

TABLE 6

| Experiment No. | Apparent density (g/cm$^3$) | Green density at a compacting pressure of 5 t/cm$^2$ (g/cm$^3$) | Particle size distribution (%) +80 | 80~100 | 100~150 | 150 ~ 200 (mesh) | 200~250 | 250~325 | −325 |
|---|---|---|---|---|---|---|---|---|---|
| 1 | 2.74 | 6.61 | 0.3 | 5.3 | 26.6 | 20.1 | 4.9 | 31.5 | 11.3 |
| 2 | 2.71 | 6.47 | 0.1 | 6.5 | 24.3 | 19.7 | 7.1 | 29.8 | 12.5 |
| 3 | 2.87 | 6.52 | 3.2 | 11.3 | 20.1 | 26.8 | 10.5 | 18.5 | 9.6 |
| 4 | 2.81 | 6.49 | 2.8 | 12.7 | 21.8 | 25.2 | 8.8 | 15.4 | 13.3 |
| 5 | 2.85 | 6.59 | 5.5 | 11.6 | 21.2 | 27.4 | 13.2 | 8.9 | 12.2 |
| 6 | 2.93 | 5.84 | 4.4 | 7.8 | 25.1 | 23.7 | 14.2 | 4.6 | 20.2 |
| 7 | 2.62 | 6.81 | 0.3 | 8.3 | 37.9 | 16.7 | 11.2 | 19.9 | 5.7 |
| 8 | 2.55 | 6.74 | 1.0 | 6.1 | 32.3 | 17.2 | 16.1 | 20.1 | 7.2 |

TABLE 7

| Kind of powder | Carbon and oxygen contents of sinter-forged steel: C (%) | O (%) | Hardenability J13 mm* ($H_RC$) | Mechanical properties: Tensile** strength (kg/mm$^2$) | Elongation** (%) | Reduction** of area (%) | Impact value*** (kg . m/cm$^2$) |
|---|---|---|---|---|---|---|---|
| Product powder of Experiment No. 2 | 0.41 | 0.0085 | 52 | 95.2 | 17.9 | 52.4 | 6.8 |
| Product powder of Experiment No. 6 | 0.42 | 0.189 | 43 | 94.0 | 14.3 | 38.9 | 1.1 |

*Hardness at a position of 13 mm from the quenched end according to Jominy test
**Specimen according to JIS No. 4 for tensile strength test: 8ϕ × G.L.30 (mm)
***Specimen according to JIS No. 4 having a V-notch of 2 mm for Charpy impact test In Table 7, the powder of Experiment No. 2 was admixed with a graphite granule in such an amount that the carbon content of the resulting sinter-forged steel is 0.4%. However, the powder of Experiment No. 6 was used as it was without admixing with the graphite granule. These powders were pre-formed so as to have a green density of 6.5 g/cm$^3$ and then sintered at 1,150° C. in a hydrogen gas atmosphere for 1 hour. Next, the pre-form was induction heated at 1,100° C. in a mixed gas atmosphere of argon and 3% hydrogen and thereafter forged under a pressure of 9 t/cm$^2$ to form steel specimens of $30^{\square}\times150^{L}$ (mm) and $15^{\square}\times120^{L}$ (mm). The thus sinter-forged steel specimens were subjected to a heat treatment as follows.

In the Jominy test, the specimen was heated at 870° C. for 1 hour, annealed and then heated to 845° C. for 30 minutes. In the test for mechanical properties, the specimen was heated to 850° C. for 30 minutes, annealed, again heated to 830° C. for 40 minutes, quenched in oil and then tempered at 600° C. for 1 hour.

The specimen of $25.4^{\phi}\times100^{L}$ (mm) was used in the Jominy test, the specimen according to JIS No. 4 having a parallel portion size of $8^{\phi}\times50^{L}$ (mm) was used in the tensile strength test, and the specimen having a size of $10^{\square}\times55^{L}$ (mm) and a V-notch of 2 mm was used in the Charpy impact test.

In Table 7, the hardenability is expressed by a Rockwell C-scale hardness at a position of 13 mm from the quenched end and the numerical values of the mechanical properties are results measured at room temperature.

Then, each of the above Experiments will be described in order. Moreover, the reducing agent is carbon previously alloyed in the powder in Experiments 1–5 and 8 and a mixture of alloyed carbon in the powder and graphite granule admixed with the powder in Experiment 7. On the contrary, the reducing agent is mainly hydrogen gas in Experiment 6.

EXPERIMENT 1

The Mn-Cr-Mo series low alloy steel powder (A) having a carbon content of 0.72% and an oxygen content of 0.86% after water atomized was subjected to final reduction by the process of the invention. The reduction was effected by preheating to 1,050° C. under vacuum for 30 minutes and induction heating to 1,310° C. at a frequency of 8.3 kHz for 10 minutes. The thus decarburized I-cake after cooled was pulverized by a hammer mill. As mentioned above, the apparatus shown in FIG. 2 was continuously operated to produce the I-cake having a section size of 90 mm$\phi$. The thus obtained product powder had a carbon content of 0.12%, an oxygen content of 0.083% and an apparent density of 2.74 g/cm$^3$.

EXPERIMENT 2

The starting powder (A) was deoxidized and decarburized under the same conditions as described in Experiment 1. When the temperature of I-cake reached to 600° C., the I-cake was transferred in the cooling chamber and then cooled by atomizing hydrogen gas. The cooled I-cake was pulverized by a hammer mill to obtain a product powder having a carbon content of 0.15%, an oxygen content of 0.025% and an apparent density of 2.71 g/cm$^3$. Thus, when the reoxidation is substantially and completely prevented during the temperature drop of I-cake, the oxygen content of the product powder can be considerably decreased.

EXPERIMENT 3

The same starting powder (A) as used in Experiment 1 was subjected to final reduction by the process of the invention. In this case, the interior of the apparatus was maintained in a neutral gas atmosphere of $N_2+3\%H_2$ and the pressure inside the apparatus was 1.1 atm. The starting powder was preheated at 1,050° C. for 30 minutes, induction heated at 1,310° C. for 10 minutes and then cooled in the same atmosphere. The thus obtained I-cake was pulverized by a hammer mill to obtain a product powder having an apparent density of 2.87 g/cm$^3$, a carbon content of 0.13% and an oxygen content of 0.089%. Such carbon and oxygen contents are about the same as those of Experiment 1, so that it can be seen that the process of the invention is effective in the neutral gas atmosphere.

EXPERIMENT 4

The same starting powder (A) as used in Experiment 1 was treated by the process of the invention in an inert gas atmosphere of argon. The pressure inside the apparatus was 1.1 atm like Experiment 3. The preheating and induction heating conditions were the same as described in Experiments 1–3. Moreover, the dew point of the atmosphere was lower than that (−20° C.) of Experiment 3 and was −40° C. Therefore, the oxygen content of the resulting product powder was as low as 0.054%. The carbon content was 0.14% and was about the same as those of Experiments 1–3. The apparent density of the product powder was 2.81 g/cm$^3$.

EXPERIMENT 5

The same starting powder (A) as used in Experiment 1 was treated by the process of the invention except that the interior of the apparatus was maintained in a pure hydrogen gas atmosphere having a dew point of lower than −50° C. and the pressure inside the apparatus was 1.1 atm. The preheating and induction heating conditions were the same as described in Experiment 1. The thus obtained I-cake was pulverized by a hammer mill to obtain a product powder having a carbon content of 0.12%, an oxygen content of 0.036% and an apparent density of 2.85 g/cm$^3$. This low oxygen content is due to the fact that the cooling of I-cake is effected in the pure hydrogen gas atmosphere and the reoxidation during the temperature drop of I-cake can be substantially completely prevented like the case of Experiment 2. Moreover, the reduction mechanism of this example is as follows.

(i) Even if the atmosphere is the reducing gas, according to the invention, the deoxidation substantially proceeds with alloyed carbon in the starting powder.

(ii) At the preheating step, the starting powder is indirectly heated from exterior, so that the deoxidation proceeds somewhat with the reducing gas atmosphere. However, the retention time at the preheating step is short, so that the deoxidation amount is little.

(iii) The real deoxidation is caused by alloyed carbon in the starting powder at the induction heating step. That is, the starting powder is rapidly and forcedly heated from the interior of the particles at the induction heating step, so that the deoxidation is preferentially caused by the alloyed carbon rather than the reducing gas.

(iv) Although each of the retention times at the preheating step and the induction heating step is relatively short, a part of alloyed carbon in the powder is decarburized by the hydrogen gas.

(v) There is not great difference in the carbon content and oxygen content of the product powder between this example and Experiment 2 applying the process of the invention under vacuum.

In Experiments 1–5, the weight ratio of the estimated carbon content serving for deoxidation to the oxygen content of the starting powder is 0.66. Further, in these experiments, the final reduction was effected so as to render the target carbon content of the product powder after deoxidized to 0.15%. As a result, the carbon content of each product powder was within a range of 0.12–0.15% and was substantially coincident with the target carbon content. Thus, according to the invention, the carbon content of the product powder can be adjusted. In this case, it is important to sufficiently adjust the carbon and oxygen contents of the starting powder before applying the process of the invention. In Experiments 1–5, the oxygen content of each of the product powders is as low as less than 1,000 ppm. On the other hand, when the conventional gas reduction system is applied to the alloy steel powder with Mn, Cr and the like capable of forming relatively stable oxides as in the starting powder (A), the effective deoxidation cannot be anticipated and hence it is difficult to obtain the product powder having low oxygen content as mentioned above.

As seen from Table 5, the weight ratio ($\Delta C/\Delta O$) of the decarburization amount to the deoxidation amount in Experiments 1–5 is within a range of 0.68–0.77 and corresponds to a mole ratio of 0.91–1.03. Therefore, if it is intended to coincide the carbon content of the product powder with the target carbon content and to lower the oxygen content as far as possible by the process of the invention, it is important to severely control the thermodynamically calculated oxygen partial pressure and dew point of the atmosphere during the reduction in addition to the severe adjustment of the carbon and oxygen contents of the starting powder.

EXPERIMENT 6

This experiment shows an example of applying a well-known gas reduction system to the starting powder (A). In this case, a pure hydrogen having a dew point of lower than −50° C. was used as a reducing gas and the apparatus used for the reduction was a large-sized and batch-type electric furnace wherein the core tube was made of 25%Cr–20%Ni austenitic stainless steel. The temperature rise of the furnace took about 2 hours and the reduction was effected at 1,150° C. for 5 hours. After completion of the deoxidation (i.e. reduction), the resulting sintered cake was pulverized by a hammer mill to obtain a product powder having a carbon content of 0.46%, an oxygen content of 0.248% and an apparent density of 2.93 g/cm$^3$. In this example, the apparent weight ratio of the decarburization amount to the deoxidation amount was as low as 0.425. Moreover, since the retention time at the reduction temperature was as long as 5 hours, the pulverizability of the sintered cake was somewhat inferior as compared with that of the invention.

In the conventional hydrogen gas reduction system as in this example, though hydrogen having low thermodynamically calculated oxygen partial pressure and dew point is used, the oxygen content of the product powder cannot sufficiently be lowered and is fairly higher than those of Experiments 1–5 due to the following facts.

(i) The heating temperature can not be raised above a certain upper limit because the heat resistance of the core tube and the like is restricted.

(ii) The reduction proceeds from the surface of the particles in the starting powder due to the indirect heating system.

(iii) The thermodynamic efficiency is substantially inferior to that of the reduction with carbon as mentioned above.

Moreover, though it is considered that carbon contributes somewhat to the deoxidation, this example is essentially the reduction with hydrogen gas, so that the decarburization amount is relatively small and hence the residual carbon content of the product powder becomes larger. Such product powder is poor in the compressibility and rattler value. In the conventional gas reduction system, it is necessary to use a wet hydrogen having a higher dew point in order to remove the carbon of the starting powder by decarburization, but the deoxidation is conversely difficult, so that the use of the wet hydrogen is not preferable. From this reason, the alloyed carbon content of the starting powder in the conventional gas reduction system should be decreased as far as possible and hence the production of the alloy steel powder with Mn, Cr and the like as in the starting powder (A) becomes difficult technically. That is, the molten steel alloyed with Mn and Cr and limiting the carbon content to low value is considerably high in the viscosity, so that the clogging of nozzles for molten steel is caused during the water atomization and consequently the temperature of the molten steel should be increased to 1,700° C. or more. At such high temperature, not only the life of the furnace refractory is extremely shortened, but also the dissolved refractory is included into the steel, so that the amount of non-metallic inclusions in the atomized steel powder becomes considerably large. As a result, the material of the sinter-forged steel obtained by using such powder is considerably poor and is not meeting with favour. This fact is caused even in the case of the insufficiently deoxidized steel powder. For instance, when the sinter-forged steel having a carbon content of 0.4% is produced by using the steel powder of each of Experiments 2 and 6 as the raw material, as shown in Table 7, the former low-oxygen steel powder is superior in the hardenability and the toughness such as elongation, reduction of area, impact value and the like to the latter, so that it will be understood that the deoxidation of the starting powder is very important. Moreover, the carbon contents of these sinter-forged steels are substantially equal, but the oxygen content is 85 ppm in the former case and 1,890 ppm in the latter case. As seen from the data of Table 7, it is desirable to decrease the oxygen content of the steel powder for sinter-forging as far as possible. Judging from many experiments, the upper limit of acceptable oxygen content of steel powder for sinter-forging is considered to be about 1,800 ppm.

EXPERIMENT 7

In this example, the powder (B) of Table 2 was used as the starting powder. This powder was produced by pulverizing sponge iron obtained by reducing mill scale with coke and had a carbon content of 0.31% and an oxygen content of 1.32%. Since the carbon content as a reducing agent was relatively deficient, the weight ratio of the carbon content serving for deoxidation to the oxygen content of the starting powder was adjusted to 1.20 by admixing with graphite granules of 1.28%. As the non-oxidizing atmosphere, there was used a vacuum having a thermodynamically calculated oxygen partial pressure of $2.94\times10^{-2}$ mmHg and also the preheating and induction heating conditions were 980° C.×30 min and 1,200° C.×10 min, respectively. The product powder obtained after the final reduction had a carbon content of 0.008%, an oxygen content of 0.211% and an apparent density of 2.62 g/cm$^3$. Even when the total carbon content as the reducing agent is sufficient as in this example, if the thermodynamically calculated oxygen partial pressure exceeds $2.1\times10^{-2}$ mmHg, the oxygen content of the product powder can not be made to less than 0.18%. Because, it is considered that a very small amount of oxygen leaking into the apparatus promotes the decarburization during the induction heating and accelerates the reoxidation during the temperature drop of I-cake. Therefore, the weight ratio of the decarburization amount to the deoxidation amount in this example is apparently as high as 1.43. As seen from this example, even if almost of carbon as the reducing agent is supplemented by admixing, it is possible to effectively practice the process of the invention.

EXPERIMENT 8

The powder (C) of Table 2 was subjected to a final reduction by the process of the invention. This powder was the rough reduced iron powder made from mill scale and had a carbon content of 0.15% and an oxygen content of 0.82% which are smaller than those of the powder (B). In this example, the starting powder was subjected to the final reduction without supplement of graphite granule as the carbon content is relatively small different from Experiment 7. Therefore, the weight ratio of the carbon content serving for deoxidation to the oxygen content of the starting powder was 0.17. As the non-oxidizing atmosphere, there was used a vacuum like Experiment 7 except that the thermodynamically calculated oxygen partial pressure was $1.91\times10^{-2}$ mmHg. Furthermore, the preheating and induction heating conditions were the same as used in Experiment 7. The resulting I-cake after the final reduction was pulverized by a hammer mill to obtain a product powder having a carbon content of 0.006%, an oxygen content of 0.433% and an apparent density of 2.55 g/cm$^3$. Even when the thermodynamically calculated oxygen partial pressure is sufficiently low, if the carbon content as the reducing agent is relatively small, i.e. the weight ratio of the carbon content serving for deoxidation to the oxygen content of the starting powder is less than 0.35, it can be seen from this example that the oxygen content of the product powder cannot be made to less than 0.18%. Moreover, the iron product powder obtained in this example can sufficiently be used for powder metallurgy.

As seen from Experiments 1–5, 7 and 8, the mole ratio of the decarburization amount to the deoxidation amount by the process of the invention is substantially within a range of 0.45–2.00 and is supported by the other many experiments. However, there are few data below the lower limit, so that the lower limit of 0.45 is not a definite significancy. In the practice of the invention, it is important that the alloyed or admixed carbon content, the atmosphere to be used and the reduction conditions are determined by accounting the oxygen content of the starting powder and the objective oxygen content of the product powder.

As seen from these experiments, the invention not only provides the deoxidation method for final reduction of iron-base metallic powder, but also makes it possible to improve the quality of the iron-base metallic powder and to provide novel powders. That is, the apparent density, particle size distribution, compressibility, formability and the like of the product powder can be arbitrarily changed. Thus, the invention is of very wide application.

What is claimed is:

1. An apparatus of vertical type for producing low-oxygen iron-base metallic powder, which comprises (a) means for feeding a starting powder composed of iron-bae metallic raw powder to be subjected to a final reduction, which has an apparent density in filled state corresponding to 16–57% of theoretical true density, an oxygen content of not more than 6% by weight and a particle size of not more than 1 mm, and carbon and/or carbonaceous granule to be alloyed in and/or admixed with the iron-based metallic raw powder in an amount corresponding to not more than a target alloying carbon content of a final product (% by weight)+an oxygen content of the powder just before the final reduction (% by weight)$\times$1.35, (b) a preheating a sintering device for preheating the starting powder from the feeding means to form a preheated and sintered cake, (c) an induction heating device for subjecting the preheated and sintered cake to the final reduction by induction heating to form an induction heated cake, (d) a pushing member for transferring the starting powder downwardly from the feeding means to the preheating and sintering device, (e) a dummy bar, housed in the bottom portion of said apparatus and extending upwardly therefrom for holding the starting powder in the beginning of the operation, while descending downwardly, (f) means for holding and descending the induction heated cake, (g) a synchronous device for synchronizing the dummy bar with the pushing member, (h) means for adjusting and maintaining at least interiors of the preheating and sintering device and the induction heating device in a non-oxidizing atmosphere having a thermodynamically calculated oxygen partial pressure of not more than $2.1\times10^{-1}$ mmHg and a dew point of not more than +5° C., (i) means for cutting the induction heated cake, into a predetermined length, (j) means for cooling the cut cake, and (k) means for pulverizing the cooled cake, so as to obtain low-oxygen iron-base metallic powder.

2. An apparatus as claimed in claim 1, wherein said means for adjusting and maintaining at least interiors of the preheating and sintering device and the induction heating device in a non-oxidizing atmosphere of vacuum is constituted with a mechanical booster pump for evacuation and a rotary pump.

3. An apparatus as claimed in claim 1, wherein said means for adjusting and maintaining at least interiors of the preheating and sintering device and the induction heating device in a non-oxidizing atmosphere of a reducing gas, a neutral gas or an inert gas is constituted with an upper conduit, a lower conduit and an exhaust pipe.

4. An apparatus as claimed in claim 1, wherein said induction heating device is provided with a power source for applying an alternating power of 50 Hz to 500 kHz.

* * * * *